United States Patent [19]

Gupta et al.

[11] Patent Number: 4,720,705

[45] Date of Patent: Jan. 19, 1988

[54] VIRTUAL RESOLUTION DISPLAYS

[75] Inventors: Satish Gupta, Croton-On-Hudson, N.Y.; Bruce D. Lucas, Pittsburgh, Pa.

[73] Assignee: International Business Machines Corporation, Armonk, N.Y.

[21] Appl. No.: 775,570

[22] Filed: Sep. 13, 1985

[51] Int. Cl.[4] ..... G09G 1/06

[52] U.S. Cl. ..... 340/724; 340/735; 340/748; 340/790

[58] Field of Search ..... 340/730, 724, 728, 731, 340/735, 744, 748, 790; 382/45, 47

[56] References Cited

U.S. PATENT DOCUMENTS

| | | | |
|---|---|---|---|
| 4,212,008 | 7/1980 | Hopkins, Jr. | 340/728 X |
| 4,237,457 | 12/1980 | Houldsworth | 340/728 |
| 4,297,691 | 10/1981 | Kodama et al. | 340/728 X |
| 4,482,893 | 11/1984 | Edelson | 340/728 X |
| 4,532,503 | 7/1985 | Pennebaker | 340/728 |
| 4,586,037 | 4/1986 | Rosener et al. | 340/728 |
| 4,591,844 | 5/1986 | Hicken et al. | 340/728 |

*Primary Examiner*—Gerald L. Brigance
*Assistant Examiner*—Jeffery A. Brier
*Attorney, Agent, or Firm*—Douglas W. Cameron

[57] ABSTRACT

A method for improving the viewing quality of a CRT display image without increasing resolution of the display. With the invention disclosed herein, characters are apparently positioned at sub-pixel locations to improve the viewing quality of a CRT display image. This apparent positioning is accomplished by changing intensity values assigned to pixels on a CRT display. In the preferred embodiment, the change in intensity values is effected by linear interpolation with intensity values of neighboring pixels to yield second intensity values. These second intensity values, then, improve the viewing quality of the CRT display image.

6 Claims, 17 Drawing Figures

FIG. 3A

| | | | | | |
|---|---|---|---|---|---|
| 0 | 0 | 7 | 7 | 0 | |
| 0 | 0 | 15 | 15 | 0 | |
| 0 | 0 | 0 | 0 | 0 | |
| 2 | 11 | 17 | 2 | 0 | |
| 0 | 13 | 24 | 1 | 0 | |
| 0 | 18 | 16 | 0 | 0 | |
| 1 | 25 | 8 | 0 | 0 | |
| 7 | 19 | 3 | 0 | 0 | |
| 14 | 25 | 10 | 0 | 0 | |
| 8 | 17 | 3 | 0 | 0 | |
| 0 | 0 | 0 | 0 | 0 | |

30 32 33 34A 34B 31 38 39 35

FIG. 3B

| | | | | | |
|---|---|---|---|---|---|
| 0 | 0 | 3 | 7 | 3 | |
| 0 | 0 | 7 | 15 | 7 | |
| 0 | 0 | 0 | 0 | 0 | |
| 1 | 6 | 14 | 9 | 1 | |
| 0 | 6 | 18 | 12 | 0 | |
| 0 | 9 | 17 | 8 | 0 | |
| 0 | 13 | 16 | 4 | 0 | |
| 3 | 13 | 11 | 1 | 0 | |
| 7 | 19 | 17 | 5 | 0 | |
| 4 | 12 | 10 | 1 | 0 | |
| 0 | 0 | 0 | 0 | 0 | |

36 37

LOGIC FLOW DIAGRAM OF METHOD

VIRTUAL RESOLUTION DISPLAYS

BACKGROUND OF INVENTION

1. Technical Field

The present invention generally relates to a method for improving the viewing quality of CRT display image without the need to increase the resolution of the CRT display, or the display memory storage space. More specifically, characters, appearing in a CRT display image, are apparently positioned at sub-pixel locations to improve the viewing quality. This apparent positioning is accomplished by changing intensity values of certain of the pixels forming characters to be shifted to second intensity values.

2. Description of the Prior Art

Images containing several characters from high resolution printers are often displayed in CRT displays of lower resolution. The characters from the printers typically come from high resolution fonts designed for the high resolution of the printer. Information as to where to position characters on the CRT display field are from printer file formats which contain address locations on a printer display field. Interpreting high resolution file formats results in command signals which are designed for the resolution of the printer and not for the low resolution of the CRT display. That is, these commands contain sub-pixel (see below) address locations and pixel intensity values. Thus, these command signals translate into commands to position characters on the CRT display at sub-pixel locations, i.e., at locations between, and not at, either discrete horizontal or vertical locations of a low resolution CRT display field. Thus, the CRT would follow these commands by rounding off to the nearest pixel location (i.e., at a discrete horizontal and vertical location of a CRT display field), often resulting in erroneous and annoying character spacings on the CRT display.

Throughout this application, unless otherwise indicated, the term "intensity value" will refer to intensity values assigned to CRT pixels. Likewise, the terms "pixel", "pixel locations" or "sub-pixel locations" shall refer, respectively, to CRT pixels or locations on the CRT display field.

Various methods have been used to place characters, from fonts designed for a high resolution bi-level display, onto a lower resolution multi-level display through the use of grey scale techniques. With these techniques, many bi-level intensity values in a number of relatively smaller (in area) bi-level pixels are replaced by a single multi-level intensity value in a relatively larger multi-level pixel. That is to say, the many bi-level intensity values have been replaced by a low resolution (or grey scale) representation. These grey scale techniques are also referred to as anti-aliasing and are discussed by F. C. Crow in a thesis entitled "The Aliasing Problem in Computer Synthesized Shaded Images", University of Utah, March 1976. Various grey scale techniques have also been used to obtain low resolution representations of characters in a font. U.S. Pat. No. 4,158,200 to Seitz et al discusses a method to facilitate the display of grey scale representations of characters in a particular font. In Seitz, a character generator stores signals representing the characters to be displayed. The signals are in binary form and represent multi-level intensity values or levels of grey scale. U.S. Pat. No. 4,385,293 to Wisnieff discloses the use of grey scale levels at discrete points of an AC plasma panel, wherein the grey scale levels are stored in binary form in shift registers. Finally, John E. Warnock discusses storing grey-scale or low resolution representations of characters from a particular font in memory in an article entitled: "The Display of Characters Using Grey Level Sample Arrays". (Computer Graphics SIGGRAPH'80 Conference Proceedings July 1980). In this article, Warnock also discusses storing several different versions of each character, each version representing a different apparent sub-pixel positioning of the character. However, this method requires a large CRT display memory storage space. For example, in a typical case, where the resolution of the printer display is about 8000 pixels per character and the CRT display about 80 pixels per character; 100 different character definitions for each character would have to be stored in memory.

There is need, therefore, for a simple method to improve the viewing quality in a CRT display image by apparently positioning characters appearing therein at sub-pixel locations. This positioning must occur without the expense of increasing either pixel resolution in the CRT display or CRT memory storage space. This need is particularly apparent when characters, of an image from a relatively higher resolution printer display, are formed in a CRT display of relatively lower resolution.

SUMMARY OF THE INVENTION

The present invention provides a method to satisfy the need to improve the viewing quality of a CRT display image, without increasing resolution or display memory storage space. This need is particularly apparent when characters of relatively high resolution are formed in a CRT display of relatively low resolution.

Accordingly, the present invention relates to a method for improving the viewing quality of CRT display image by apparently positioning characters at sub-pixel locations in a CRT display. This apparent positioning involves changing previously assigned intensity values of at least some of selected CRT pixels to second intensity values. This invention also includes the specific method, linear interpolation, by which intensity values are changed to second intensity values. Furthermore, this invention also includes the specific choice of which intensity values are actually interpolated with each other. Both linear interpolation and the choice of which and how many intensity values are used in the interpolation further simplify improving display image quality without requiring more resolution or CRT display memory storage space.

BRIEF DESCRIPTION OF THE DRAWINGS

The invention may be clearly understood from a consideration of the following detailed description and accompanying drawings in which:

FIG. 3A represents a CRT display field with intensity values assigned to CRT pixels;

FIG. 3B represents a CRT display field with second intensity values assigned to CRT pixels;

DESCRIPTION OF THE PREFERRED EMBODIMENT

Figure 1:
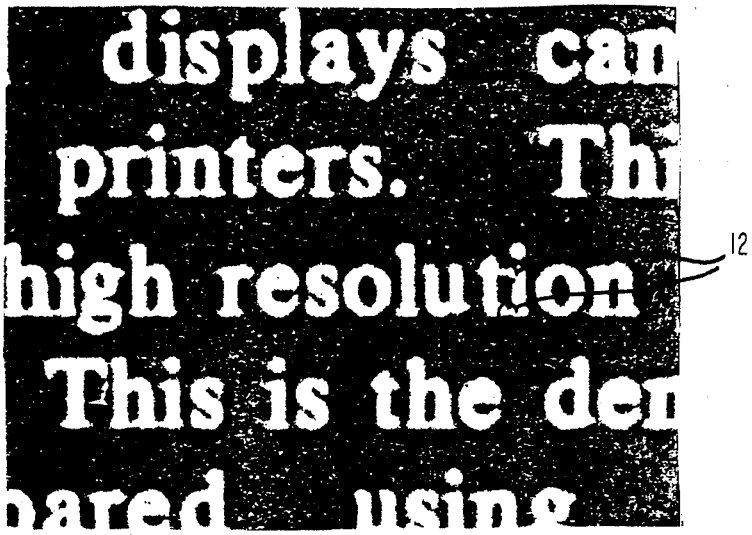
FIG. 1 is a representation of CRT display image of characters in a CRT display using format commands from a printer without apparent sub-pixel positioning.
Figure 2:
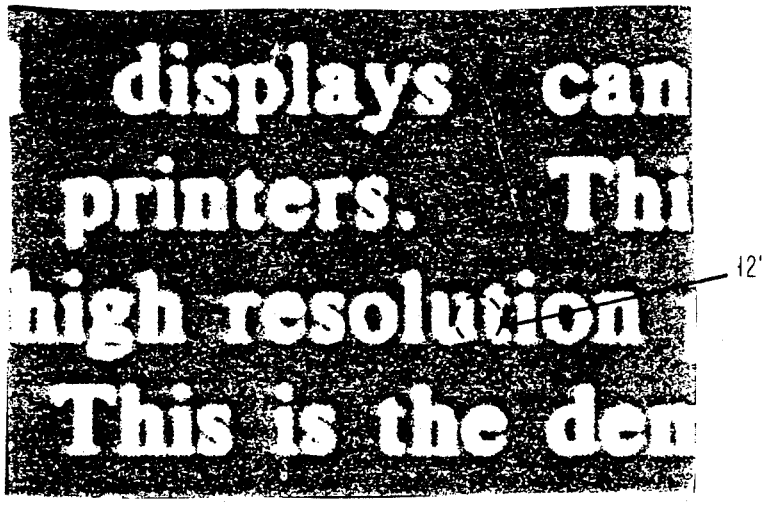
FIG. 2 represents an improvement of the viewing quality of the CRT display image quality of FIG. 1 by the apparent positioning of characters at sub-pixel locations in accordance with the present invention.

Referring now to the drawings, and more particularly to FIG. 1, there is shown an image of characters in a CRT display, with unchanged intensity values. Notice, in FIG. 1, the close spacing 12 between the "t" and the "i" in the word "resolution". FIG. 2 shows improved viewing quality of the CRT display image, using the methods of this invention. Here, the spacing (12') is increased to improve the viewing quality image. Thus, in going from FIG. 1, to FIG. 2, one sees an apparent shift of the character "i" by a sub-pixel distance to the right. Or, in FIG. 2, one sees an apparent positioning of the character "i" at a sub-pixel location. This apparent sub-pixel positioning of character "i" is accomplished by a changing of certain of the intensity values of pixels forming this character to second intensity values.

FIG. 3A is a schematic diagram of a plurality of adjacent pixels 31 in a CRT display field 30 with assigned intensity values (32) and with representative pixel locations 33. Also shown are discrete horizontal locations 34A and discrete vertical locations 34B. All locations, except pixel locations 33, shall be referred to as sub-pixel locations. FIG. 3B shows the same display field but with second intensity values 36 which were the result of changing the intensity values of FIG. 3A to the second intensity values of FIG. 3B. In FIG. 3A, there are shown several rows of pixels. See, for example, row 35 with five adjacent pixels, and parts of pixels 38 and 39 horizontally adjacent to row 35. FIG. 3B shows the same rows of pixels as FIG. 3A, but with the intensity values of FIG. 3A changed to second intensity values. Row 37 of FIG. 3B is the same row as row 35 of FIG. 3A, but with second intensity values assigned to the pixels. FIGS. 3A and 3B also represent a plurality of pixels which form a character when displayed with the intensities shown.

Figure 4A:
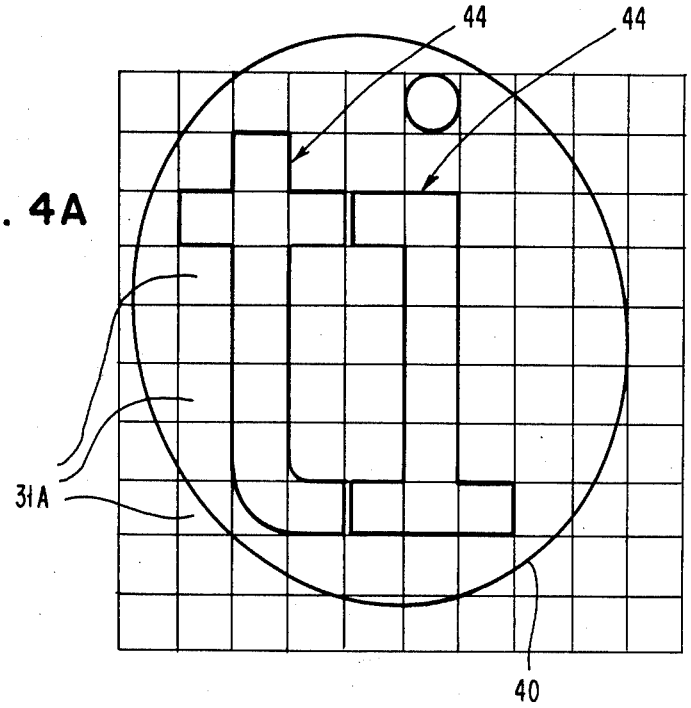
FIG. 4A represents an enlarged CRT display image of characters of an image not using the method of this invention.
Figure 4B:
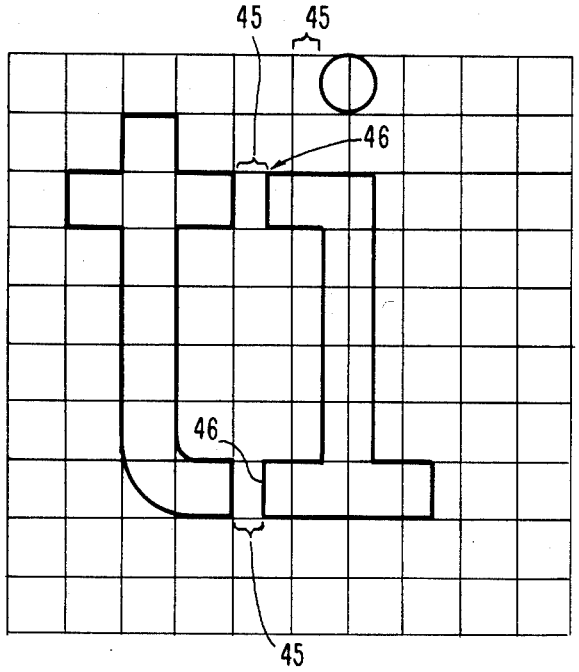
FIG. 4B represents an enlarged CRT display image of characters, positionable at pixel locations, but which have been apparently positioned at sub-pixel locations.

FIG. 4A is a schematic of pixels 31A forming the characters (44), "i" and "t". Since there can only be one intensity value per pixel and hence only one degree of brightness per pixel, the characters are positionable only at pixel locations. FIG. 4B illustrates the apparent shift of the characters by sub-pixel distances 45, or the apparent positioning of the character "i" at a sub-pixel location 46. In FIG. 4A the pixels 31A were assigned intensity values so as to produce the image 40. The image 40 of FIG. 4A was improved in viewing quality by apparently increasing the distances between the "i" and "t" by changing the intensity values to second intensity values so to effect an apparent shift of the character "i" (44) by a sub-pixel distance 45 as shown in FIG. 4B.

Figure 5A:
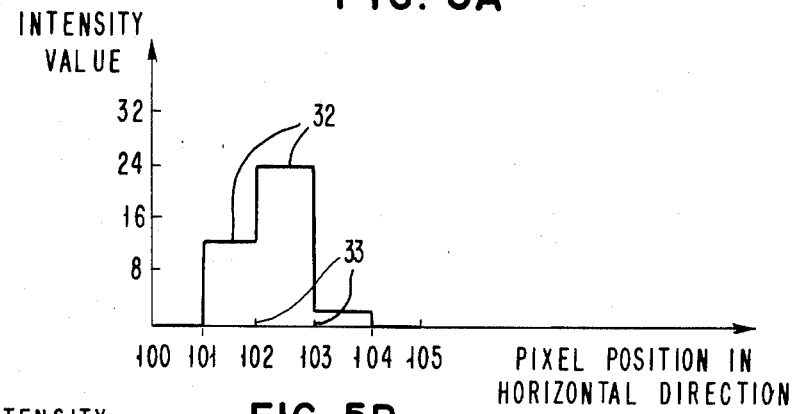
FIGS. 5A, B, and C illustrate the method (linear interpolation) of changing the intensity values assigned to the CRT pixels to second intensity values.
Figure 5B:
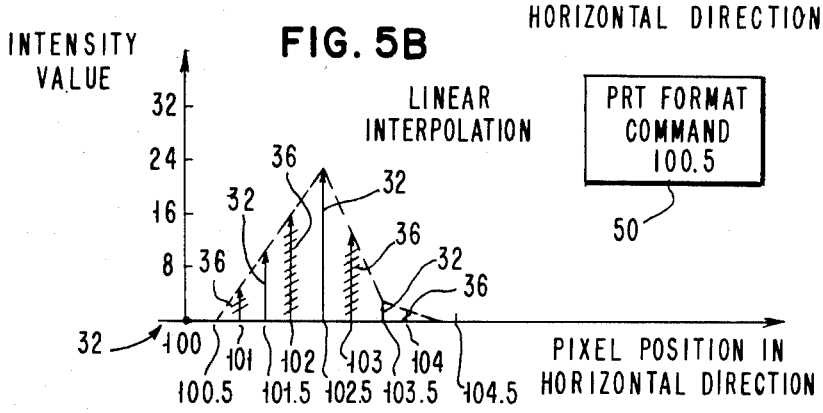

FIGS. 5A, B and C show a schematic of the preferred method of changing intensity values 32 in FIG. 5A to second intensity values 36 of FIGS. 5B and C. This preferred method is linear interpolation shown in FIG. 5B. Linear interpolation, in the preferred embodiment, is applied on a row (see 35 of FIG. 3A) by row basis. That is, linear interpolation is applied to one row at a time with the linear interpolation of intensity values in one row not affecting the linear interpolation of intensity values in another row. Linear interpolation is applied to all rows forming a character to be apparently positioned at a sub-pixel location. The sinc function can also be used as a means of changing first intensity values to second intensity values. The integral numbers 100 through 105 represent pixel locations (33) in a horizontal direction (i.e., across the display from left to right or from right to left) on the CRT display field 30 of FIG. 3A, and the space in between the above numbers is a one dimensional representation of pixels 31 of FIG. 3A on the CRT display field 30. FIG. 5A is a schematic graph depicting some of the assigned intensity values (32) as a function of pixel locations in a row of pixels in on the CRT display field.

Again, referring to FIGS. 5A, B, and C, the chart 50 to the right of the graph of FIG. 5B depicts a command signal containing a sub-pixel address location or a printer pixel address location from printer file formats. Thus, there is a command to position a character at a sub-pixel location, which is a location between, and not at, the pixel locations represented by the integers 100, 101, 102, 103, . . . . While these commands cannot actually be carried out on the low resolution CRT display field 30, they can be apparently (that is to the eye of the viewer) carried out using the linear interpolation depicted in FIG. 5B. Linear interpolation can be graphically depicted as follows. The arrows representing the intensity values 32 are positioned at points on the graph according to the printer pixel locations identified from the printer file formats. Since the printer display field is of higher resolution than the CRT display, these printer pixel locations will usually identify sub-pixel location on the CRT display field. These intensity values are then interpolated with each other. For example, in FIG. 5B the arrow representing an intensity value of 24 is shifted by one-half of a pixel to position 102.5, and the arrow representing an intensity value of 13 is shifted to sub-pixel position 101.5 (see FIG. 5B). The value 24 represents the intensity value assigned to a pixel (the one between 102 and 103) whose intensity value is to be changed. The intensity value of 24, for the pixel between pixel positions 102 and 103, is changed by interpolation with the unchanged intensity value of 13 for the neighboring or adjacent pixel between pixel positions 101 and 102 to obtain a second intensity value of 18 for the pixel between pixel positions 102 and 103. The intensity value of the pixel between 103 and 104 is changed by interpolation with the unchanged intensity value of the pixel between 102 and 103 to obtain a second intensity value of 12 for the pixel between pixel positions 103 and 104. The other intensity values assigned to the pixels on the CRT display are changed to second intensity values in the same manner as above. The pixel between 100 and 101 (n and n+1) and the pixel between 101 and 102 (n+1 and n+2) are said to be horizontally adjacent to each other.

Figure 5C:
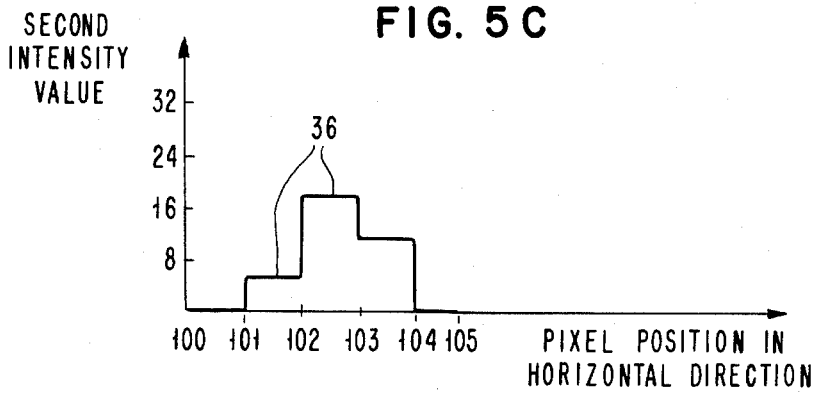

Some resultant second intensity values are shown in FIG. 5C.

Adjacent pixels of a given pixel could also be pixels above and below the given pixel.

It should be observed that the linear interpolation was performed in only the horizontal direction or along the pixels in a given row, which is the direction in which letters or characters are placed to form a word. In most cases it was found that interpolation in the vertical direction (up and down the display) was not necessary. Slight sub-pixel vertical variations in the placement of characters on the CRT display did not do much to improve image display quality. More simply, interpolation should be in the direction in which letters or characters are placed to form a word. For example, the letters of the word "the" are placed in a horizontal direction (across the page), not in a vertical direction (up and down the page). Furthermore, it was also found that one interpolation per pixel was sufficient to improve image quality on the CRT display.

The terms "horizontal direction" and "horizontally" shall refer to the direction in which characters are placed to form a word. Thus, "vertical" or "above and below" shall refer to a direction which is orthogonal to the "horizontal direction."

Figure 6:
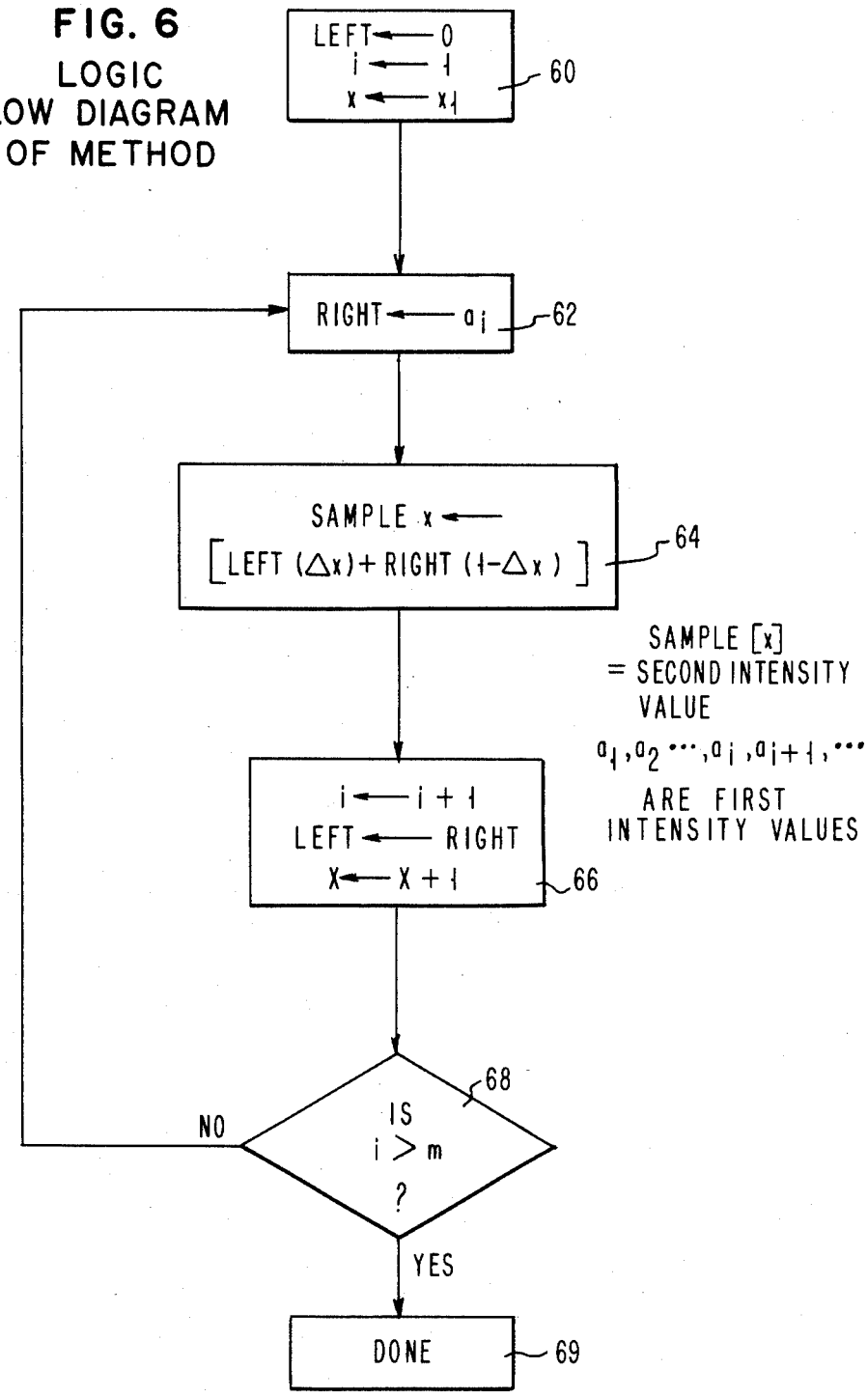
FIG. 6 represents the logic flow diagram of the algorithm to accomplish the linear interpolation of FIG. 5.

The logic flow diagram, of the algorithm used to accomplish the interpolation in this preferred embodiment, is described in the above paragraph and is shown in FIG. 6. Referring to FIG. 6, Blocks 60 and 62 show that 0 and $a_1$ are the first pair of intensity values to be interpolated with each other. Block 64 contains instructions to perform the actual interpolation to obtain second intensity values, "Sample (x)". $\Delta x$ in block 64 represents the sub-pixel distance by which a character is to be shifted. For example, in FIG. 5B, $\Delta x$ is 0.5. Applying the above parameters (0, $a_1$ and $\Delta x=0.5$), the output of block 64 is $[(0)(0.5)+(a_1)(1-0.5)]=[0.5a_1]$which value would be the second intensity for the pixel on the extreme left of a particular row, which pixel is represented by $x_1$. Block 66 represents instructions to repeat the above for $a_1$ and $a_2$. Thus, the output of block 64 would then be $[a_1(0.5)+a_2\ (1-0.5)]=[0.5a_1+0.5a_2]$. This latter value would be the second intensity value for the pixel $x_1+1$, adjacent to, and to the right of, the pixel $x_1$. Decision block 68 and block 69 contain instructions to repeat the above process up to and including i=n. Thus, the last two intensity values to be interpolated would be $a_{n-1}$ and $a_n$, and the last second intensity value (the value assigned to the right most pixel of the row) would be $[a_{n-1}(0.5)+a_n\ (1-0.5)]=[0.5\ a_{n-1}+0.5a_n]$.

The square brackets are used above to indicate that the greatest integer in the value inside the brackets is to be used. For example, [1.9]=1 and [2.5]=2.

Figure 7A:
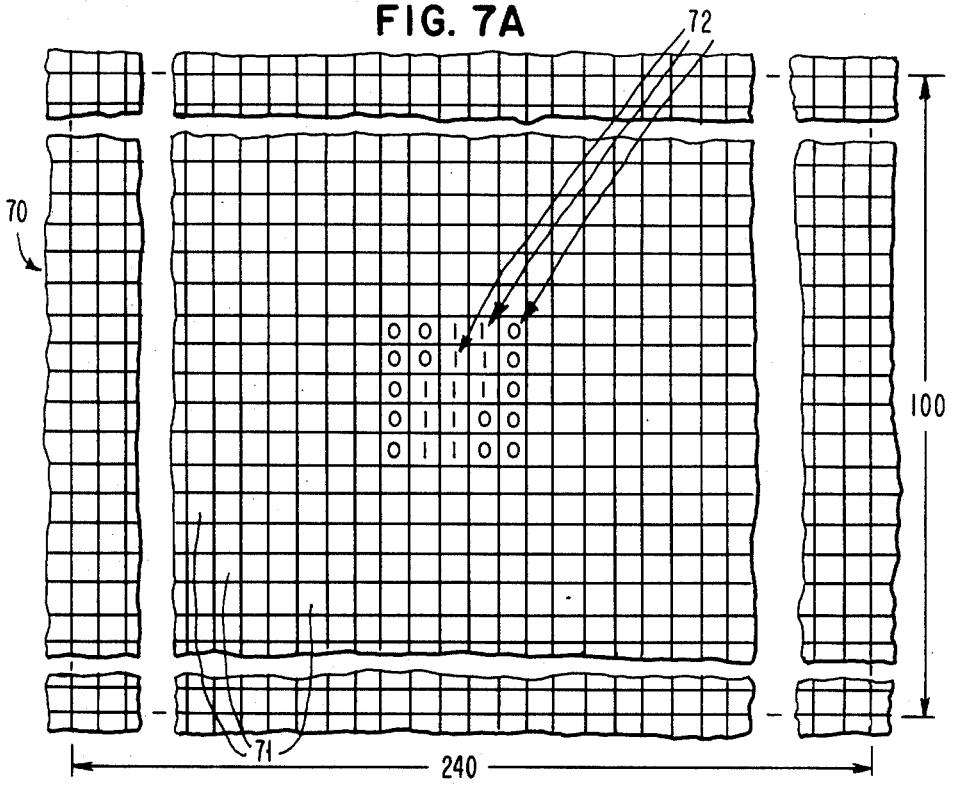
FIG. 7A schematically illustrates the assignment of bi-level intensity values to printer pixels in the bi-level printer display which is of higher resolution than that of the CRT display (7B)
Figure 7B:
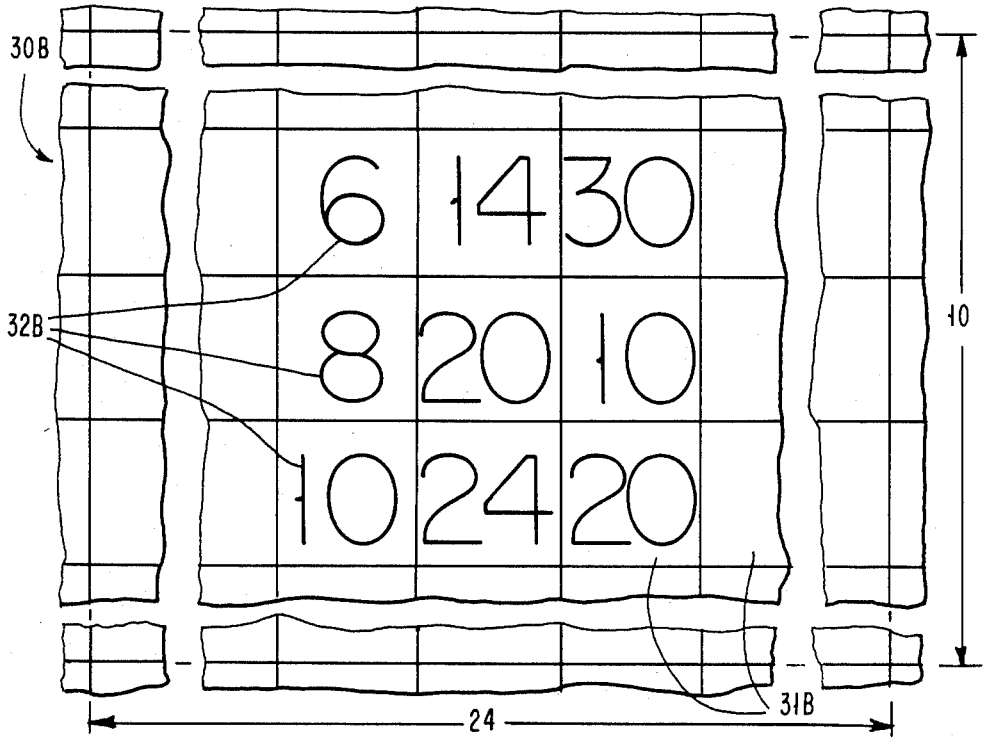
FIG. 7B schematically illustrates the assignment of respective intensity values to CRT pixels (also referred to as "pixels"), in the CRT display which is of lower resolution than that of the printer display (7A)

Referring to FIG. 7A, there is shown a schematic of a bi-level printer display field 70 with printer pixels 71 and some bi-level intensity values (72) assigned to the printer pixels or pixels of the printer display field. The term bi-level implies that each printer pixel can only be assigned an intensity value of "0" or "1". FIG. 7B, on the other hand, shows a CRT display field 30B with CRT pixels 31B and some assigned intensity values (32B) which are multi-level values. The term multi-level implies that each CRT pixel 31B can have a range of values, say, for example, from 0 to 31. FIG. 7B represents pixels on the CRT display field 30B covering the same corresponding area on the printer display field 70. That is to say, the printer pixels 71 of FIG. 7A underlie the CRT pixels 31B of FIG. 7B. Notice, that, in the same corresponding area, there are many more printer pixels 71 than CRT pixels 31B, i.e. the printer display field 70 is of higher resolution than that of the CRT display field 30B of a CRT display.

Figure 8A:
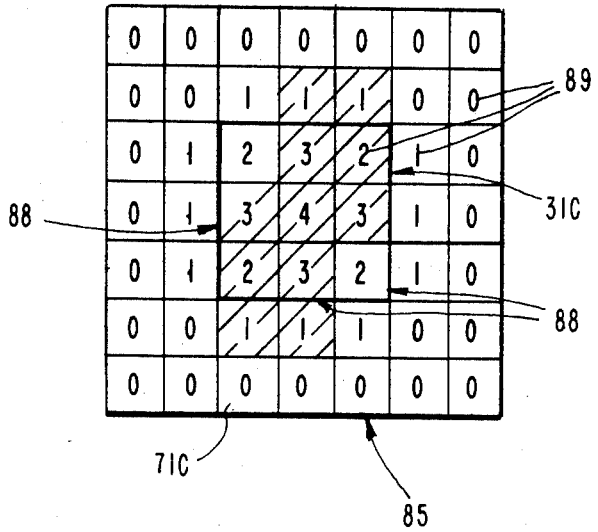
FIG. 8A represents a CRT pixel with printer pixels underlying and surrounding an area that contains at least a given CRT pixel.
Figure 8B:
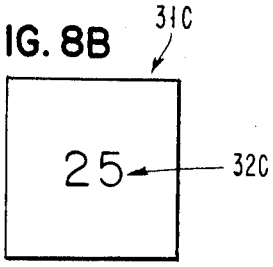
FIG. 8B represents the CRT pixel (also called "pixel") of FIG. 8A with its assigned intensity value.
Figure 8C:
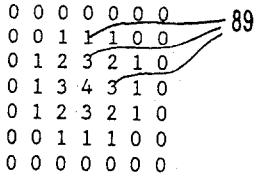
FIG. 8C illustrates the weighting function used to obtain weighted averages of the bi-level intensity values of the printer pixels of FIG. 8A which weighted averages are added to obtain the intensity value of FIG. 8B.

Referring to FIGS. 8A, 8B, and 8C, there is shown the means of assigning an intensity value to a pixel 31C of a CRT display. The larger square 31C, enclosed within the thick lines 88, of FIG. 8A represents a larger pixel of the low resolution CRT display field 30 or 30B, and the smaller squares 71C, within and surrounding the larger square, represent printer pixels 71C of the high resolution printer display field. FIG. 8B represents the larger pixel 31C shown in FIG. 8A to which an intensity value (32C) is to be assigned. The gridded area 85 of FIG. 8A represents an area on the printer display that contains at least the given CRT pixel 32C (see FIG. 8B) on the CRT display. All the smaller squares 71C of FIG. 8A represent the printer pixels 71C underlying area 85. The shaded areas of FIG. 8A represent the printer pixels whose bi-level intensity value is "1" and the unshaded areas represent the printer pixels whose bi-level intensity value is "0". FIG. 8C represents the preferred weighting function to be used, although other weighting functions could be used with equally satisfactory results. The numbers (89) in the printer pixels 71C of FIG. 8A represent weighted values assigned to the particular printer pixels, according to the weighting function of FIG. 8C. Each weighted value is multiplied by its corresponding bi-level intensity value to produce a given product. The given products are then added to yield a first intensity value (25 in this case) for the low resolution pixel of FIG. 8B. The method of obtaining multi-level intensity values, described above is known as anti-aliasing and is described in a Ph.D. thesis by F. C. Crow, entitled: "The Aliasing Problems in Computer - Synthesized Shaded Images", University of Utah, March, 1976. The relative merits of using various weighting functions is described in article by John E. Warnock, entitled: "The Display of Characters Using Grey Level Sample Arrays", Computer Graphics 14(3): 302–307, July, 1980. The above method of obtaining intensity values is also used to obtain a low resolution representations for each of the characters for the image on the printer display. It is the above intensity values that are changed to second intensity values to apparently position the characters at sub-pixel locations.

Figure 9:
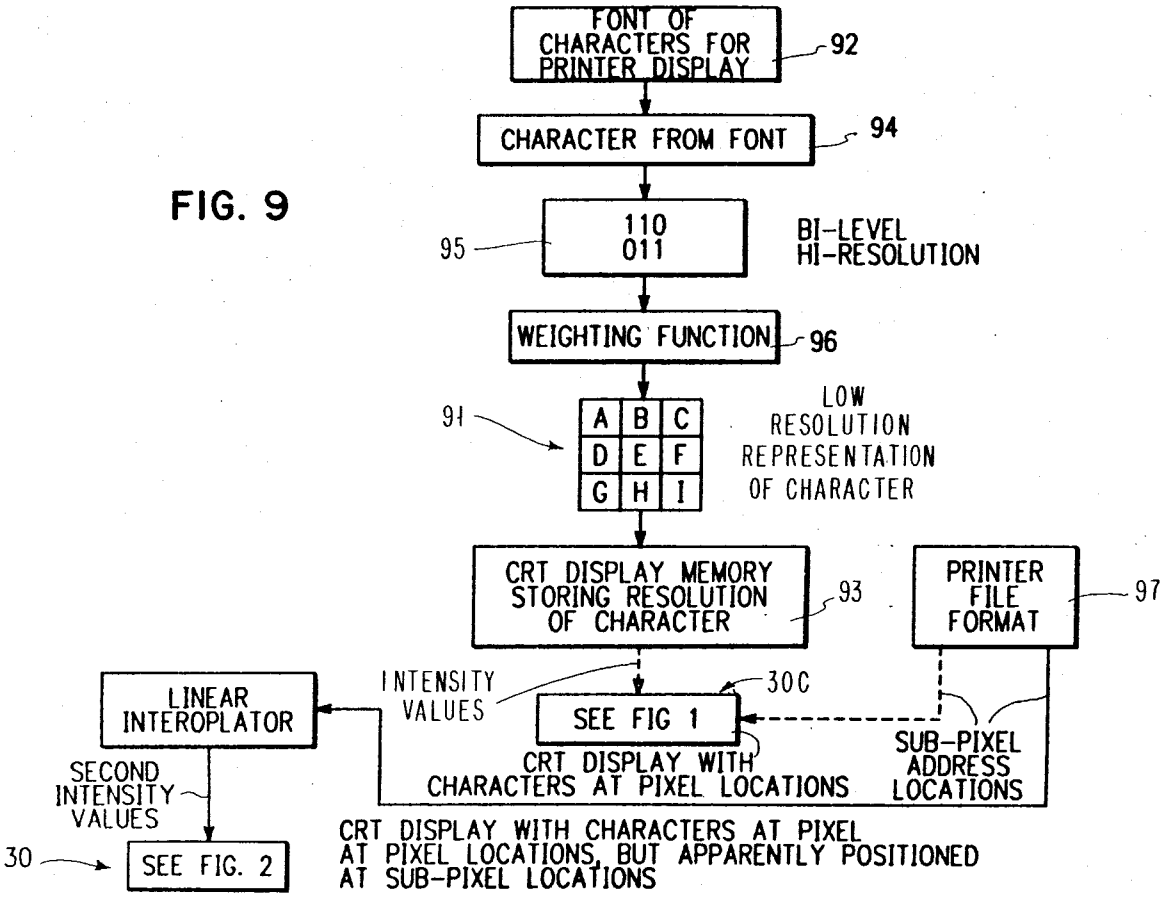
FIG. 9 schematically illustrates obtaining low resolution representations for each of the characters in a font which provides the characters for the images on the printer display, storing these low resolution representation in memory and changing intensity values to second intensity values.

FIG. 9 is a schematic representation of the preferred method of providing for the apparent positioning of a number of characters of an image at sub-pixel locations. FIG. 9 basically starts with a font 92 characters designed for a printer display. A high resolution representation is formed for each character 94 of the font 92. The high resolution representation 95 is simply a two dimensional array of 0's and 1's. The relative spatial positions of the 0's and 1's in the array correspond to relative spatial position of bi-level intensity values when they are assigned to the adjacent printer pixels. As described in the description of FIG. 7, weighting function 96 is applied to the high resolution representation 95 to obtain a low resolution representation 91. Like the high resolution representation 95, the low resolution representation is simply a two dimensional array of intensity values. However, each intensity value can usually be a number from a set of more than just two numbers. The relative spatial positioning of the intensity in the low resolution representation also has the same meaning as described for the high resolution representation. The low resolution representation is now stored in the CRT display memory 93. The above method is repeated for each character in the font which provides characters for an image in a printer display. Only one representation for each character of the font need be stored. The low resolution representations can be thought of as a two dimensional array of adjacent rectangles or squares. These rectangles or squares form a larger rectangle or square, each smaller rectangle or square being of the same dimension as the CRT pixels and having a single intensity value therein. Since we can only have one intensity value per pixel, the area in each smaller square or rectangle must cover the entire area in one and only one pixel. That is, the low resolution representations are only positionable at pixel locations. The problem then is how to position these larger square or rectangles (low resolution representations) using command signals containing sub-pixel address locations. In the preferred embodiment, conventional means are used to position the characters at a particular vertical position (see 34 of FIG. 3A), such as rounding off to the nearest vertical location. However, the methods of this invention are used to primarily to apparently position the larger rectangle or low resolution representations between horizontal pixel locations, i.e., at sub-pixel locations. See 34A of FIG. 3A for an illustration of a horizontal location. To apparently position a character at a horizontal sub-pixel position, the low resolution representation for the character is read from the CRT display memory 93. The intensity values are assigned to the CRT pixels as if the low resolution representations were positioned by means of command signals from the computer which contained only pixel locations. This assignment is realized by rounding down to the nearest pixel. For example, sub-pixel location 100.5 is rounded down to pixel location 100. The pixels are then assigned intensity values as if the command signals was 100. Now conventional methods can be used to obtain an assignment of intensity values to CRT pixels. For the preferred embodiment, conventional means are used to position the characters at vertical pixel locations. The above assignment would produce an image like FIG. 1 in the CRT display field 30C. The image that would appear in the CRT display field 30C is now improved by an apparent positioning of a number of characters at sub-pixel locations. This positioning is accomplished by changing the intensity values obtained above of certain of the pixels of the number of characters to second intensity values. The number of characters are those characters commanded to be positioned at sub-pixel locations between horizontal locations. This change of intensity values is accomplished by linear interpolator 94, as described above in the description of FIGS. 5A, B, C and 6. One could also interpolate to apparently position characters at sub-pixel locations between vertical locations, but such interpolation does not significantly improve the viewing quality of the CRT display. The second intensity values, as well as the unchanged intensity values, are then used to set the brightness of the pixels to produce an image in the CRT display **30*d*, like the image shown in FIG. 2**.

Figure 10:
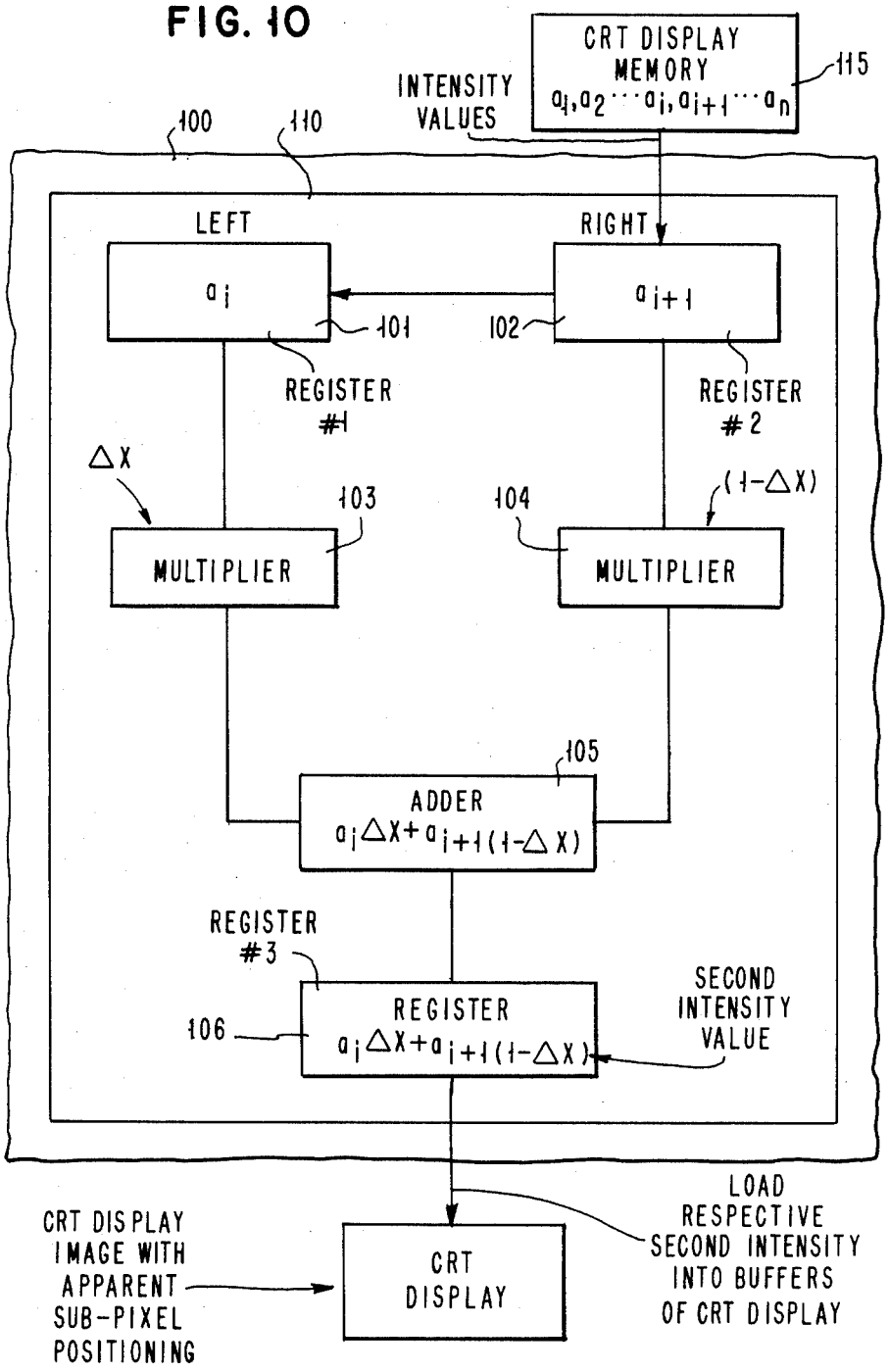
FIG. 10 schematically illustrates the apparatus and method for changing of intensity values by linear interpolation with intensity values of adjacent pixels.

Referring to FIG. 10, there is shown a schematic of the linear interpolator 110, which is part of a general purpose digital computer 100 and is used in the invention disclosed herein. The intensity values assigned to pixels of a row of pixels (see 35 of FIG. 3A) are changed to second intensity values using the apparatus of FIG. 10. This row of pixels is a horizontal array of pixels and is part of a number of rows of pixels from which a character is formed. For example, intensity values $a_i$ and $a_{i+1}$, assigned to two adjacent pixels in a given row of pixels, are loaded from the CRT display memory 115 into registers 101 and 102 respectively. $a_i$ and $a_{i+1}$ are then multiplied by $\Delta x$ and $1-\Delta x$, respectively by multipliers 103 and 104, respectively. $\Delta x$ represents the sub-pixel distance by which a character is shifted on the CRT display. The outputs of 103 and 104 are then applied to adder 105 which yields an output of $a_i\Delta x\ a_{i+1}\ 1(1-\Delta x)$. This latter output represents the second intensity value to be assigned to the pixel whose intensity value was $a_{i+1}$ on the CRT display. $a_1$ represents the pixel in the extreme left of a given row. To change $a_1$ to a second intensity value, 0 and $a_1$ are loaded into registers 101 and 102, respectively. The second intensity value replacing $a_1$, is then found in the same manner as described above for the value replacing $a_{i+1}$. The above process is repeated for each row forming the character which is to be apparently positioned at a sub-pixel location. The above procedure is then repeated for all characters to be apparently positioned. These second intensity values are then loaded into a CRT display whereby the characters are apparently positioned at a sub-pixel location to improve display viewing quality (see FIG. 2).

It is thought that method for improving display image quality on a CRT display and many of its attendant advantages will be understood from the foregoing description. It will be apparent that various changes may be made in the form, construction and arrangement of this invention without departing from the spirit and scope of this invention or sacrificing all of its material advantages. The description above is merely a preferred or exemplary embodiment of the invention herein.

Having thus described our invention, what we claim as new, and desire to secure by Letters Patent is:

1. A method for improving the viewing quality of a CRT display image by apparently positioning a number of characters appearing therein at sub-pixel locations, which said number of characters are formed from a plurality of pixels and are actually positionable only at pixel locations, said number of characters being apparently positioned at sub-pixel locations by means of command signals containing sub-pixel address locations, which signals represent commands to position said number of characters at sub-pixel locations in the CRT display field in which the image is formed, the address locations being from file formats and corresponding to pixel locations in a given display field which has a higher resolution than the CRT display field in which the image appears, said method comprising the steps of:

(a) assigning respective intensity values to pixels, so that each pixel has, at any given time, only one intensity value, and so that, the intensity value of any given pixel of the CRT display, is proportional to the sum of weighted averages of bi-level intensity values of corresponding pixels of the given display field, the corresponding pixels being pixels which form a first area of the given display field corresponding to a second area on the CRT display, which second area contains the given pixel of the CRT display field, the bi-level intensity values of the pixels of the first area of the given display field being converted into a single multilevel intensity value to be assigned to the given pixel of the second area; and (b) changing certain of the intensity values obtained in step (a), of the pixels forming the number of characters, to corresponding second intensity values by linear interpolation, the intensity value, assigned to CRT pixel whose intensity value is to be changed, being changed by linear interpolation, with an unchanged intensity value assigned to a pixel adjacent to the pixel whose intensity value is to be changed, each pixel still having only one intensity value assigned thereto, whereby the number of characters appear to be positioned at sub-pixel locations to improve the viewing quality of the CRT display image.

2. A method for improving viewing quality of a CRT display image by apparently positioning a number of characters of the image at sub-pixel locations in the CRT display field in which the image appears, which said number of characters are formed from a plurality of pixels and are actually positioned only at CRT pixel locations, said number of characters being apparently positioned at sub-pixel locations by means of command signals containing sub-pixel address locations, which signals represent commands to position said number of characters at sub-pixel locations, each pixel having at most one intensity value assigned thereto, the sub-pixel address locations being from file formats and identifying pixel locations in a given display field which has a higher resolution than the CRT display field, said method comprising the steps of:

(a) storing in a CRT display memory for the CRT display field at most one respective low resolution representation for each character of a font which provides characters for an image in the given display field;

(b) assigning first intensity values to CRT pixels of the CRT display field to correspond to the low resolution representations stored in step (a), the first intensity values also being assigned as if the number of characters were to be actually and apparently positioned at CRT pixel locations; and (c) changing first intensity values, obtained in step (b) of certain of the pixels forming the number of characters to corresponding second intensity values by linear interpolation, a first intensity value (of the first intensity values), assigned to a CRT pixel whose first intensity value is to be changed, being changed by linear interpolation, with a first intensity value assigned to a pixel adjacent to the pixel whose first intensity value is to be changed, each pixel still having only one intensity value assigned thereto, whereby a number of the characters appear to be positioned at sub-pixel locations to improve the viewing quality of the CRT display image.

3. A method as recited in claim 2, wherein the linear interpolation comprises at most one linear interpolation for each CRT pixel forming the number of characters, the interpolation being only with intensity values assigned to two adjacent pixels in the same row or between one intensity value assigned to a pixel in the row and an intensity value assigned to a pixel horizontally adjacent to the row.

4. A method for improving the viewing quality of a CRT display image by apparently positioning characters appearing therein at sub-pixel locations, which characters are formed from a plurality of pixels and which are actually positionable only at pixel locations in a CRT display field, the characters being apparently positioned at sub-pixel locations by means of command signals containing sub-pixel address locations and first pixel intensity values, which signals represent commands to position the characters at sub-pixel locations, each pixel, at any given time, having assigned thereto a single first intensity value selectable from permissible values in a predefined range, said method comprising the step of changing the first pixel intensity values of certain of the pixels forming the characters to be apparently positioned at sub-pixel locations (but actually positioned at pixel locations) to second intensity values also selectable from the permissible values in the predefined range, the changing of the first intensity values being made by linear interpolation using pairs of first intensity values assigned to adjacent pixels of the CRT display, whereby the characters, actually positioned at pixel locations, appear to be positioned at sub-pixel locations to improve the viewing quality of the CRT display image.

5. A method for improving the viewing quality of a CRT display image, as recited in claim 4, wherein the sub-pixel address locations are from file formats which contain pixel address locations in a display field of higher resolution than that of the CRT display in which the image appears.

6. A method, for improving the viewing quality of a CRT display image as recited in claim 4, wherein intensity values, before being changed, are assigned to respective pixels in the CRT display, in which the image appears, so that the intensity value, of any given CRT pixel, is proportional to the sum of weighted averages of bi-level intensity values of corresponding pixels of the given display field, the corresponding pixels being pixels which form a first area corresponding to a second area on the CRT display, which second area contains the given pixel.

* * * * *